US005921387A

United States Patent [19]

Arzoomanian et al.

[11] Patent Number: 5,921,387

[45] Date of Patent: Jul. 13, 1999

[54] PROTECTIVE COVER FOR A GOLF BAG

[76] Inventors: Mark Arzoomanian, 52 Alpine Dr., Closter, N.J. 07624; Peter Jelalian, 11 Trap Rock Cir., New City, N.Y. 10956; Mark Kanian, 37 Peach St., Nanuet, N.Y. 10954; Mark Manuelian, 128 Warren St. No. 10, Lowell, Mass. 01852

[21] Appl. No.: 08/838,145

[22] Filed: Apr. 14, 1997

[51] Int. Cl.[6] ..... A63B 55/00; A63B 57/00

[52] U.S. Cl. ..... 206/315.4; 206/522; 150/159

[58] Field of Search ..... 206/315.3, 315.4, 206/521, 522; 150/159; 248/96

[56] References Cited

U.S. PATENT DOCUMENTS

| | | | |
|---|---|---|---|
| 3,707,279 | 12/1972 | Kaiser | 206/315.4 X |
| 3,985,171 | 10/1976 | Summers et al. | 206/315.4 X |
| 4,044,867 | 8/1977 | Fisher | 383/3 X |
| 4,383,563 | 5/1983 | Kirchhoff, Jr. | 206/315.3 X |
| 5,062,528 | 11/1991 | Whitaker, Jr. | 206/315.3 |
| 5,094,345 | 3/1992 | Yonnetti | 206/315.3 X |
| 5,421,454 | 6/1995 | Chern | 206/315.6 |
| 5,458,240 | 10/1995 | Rich et al. | 206/315.3 |
| 5,515,897 | 5/1996 | Fehan | 206/315.4 X |
| 5,624,035 | 4/1997 | Kim | 206/521 X |
| 5,704,475 | 1/1998 | Jack | 150/159 X |

FOREIGN PATENT DOCUMENTS

| | | | |
|---|---|---|---|
| 6277315 | 10/1994 | Japan | 248/96 |
| 6315551 | 11/1994 | Japan | 248/96 |
| 9216266 | 10/1992 | WIPO | 206/315.3 |

*Primary Examiner*—Sue A. Weaver

*Attorney, Agent, or Firm*—Cohen, Pontani, Lieberman & Pavane

[57] ABSTRACT

A removable protective cover is used in combination with a golf bag which includes a bladder for protecting the heads of golf clubs and other equipment carried in a golf bag. The cover is removably affixable to the golf bag and when disposed thusly, the bladder may be inflated to securingly envelop the golf club heads and provide a protective barrier against the club heads contacting each other and against club heads contacting some other hard surface, e.g. the ground, conveyor belt, etc. The golf bag includes a tray having a plurality of substantially downwardly extending tubes suitable for holding golf clubs. A recess is also provided in the tray for holding miscellaneous golf equipment such as, for example, balls, tees, etc. The tray also includes a cigar or cigarette holder and a utility outlet for connection to a computer or cellular phone. The cover includes an inclined top surface, while the bottom surface of the golf bag is substantially horizontal. The golf bag and cover preferably include hard external shells and are hexagonal in cross-section.

19 Claims, 8 Drawing Sheets

PROTECTIVE COVER FOR A GOLF BAG

BACKGROUND OF THE INVENTION

1. Field of the Invention

This invention relates to a cover for protecting golf equipment and, more particularly, to a removable cover for a golf bag configured for isolating and securing golf clubs and golf equipment carried therein.

2. Description of the Related Art

As both a business and recreational activity, golf clubs are usually transported in a car trunk and/or an airplane cargo bay when traveling for business and/or pleasure. In addition to the sometimes hostile environment of a trunk or cargo bay, the golf equipment may be carelessly handled by baggage carriers, bell-hops, cab drivers, etc. In any case, the golf clubs may be damaged by contact with a hard surface, e.g. the ground, or by contact with each other within the golf bag. Because of the sizable investment and the ever present possibility of damage during transit, it is essential that the golf clubs be protected when traveling.

Previous attempts to protect the heads and shafts of golf clubs have been primarily concerned with reducing the possibility that the club heads will contact the ground or other hard object, or that the clubs will fall completely out of the bag. U.S. Pat. No. 5,515,897 to Fehan discloses a flexible golf bag cover for use when transporting a golf bag. This cover encompasses the entire golf bag and is primarily flexible with a rigid bottom section having wheels or casters mounted thereon. When placed around a golf bag, the cover disclosed in Fehan does not prevent the clubs from moving about within the bag and contacting each other. Furthermore, this flexible cover offers scant protection for the golf club heads against contact with a hard surface.

In another attempt to protect golf clubs in a golf bag, U.S. Pat. No. 3,985,171 to Summers et al. discloses a protective cover having two internal compartments —one for irons and one for woods—which may be placed over the golf club heads. A resilient cord secures the cover to the golf bag and serves to further define the compartments when in place. This cover provides minimal protection against damage from external sources and does not prevent the club heads from contacting each other.

U.S. Pat. No. 5,421,454 to Chern discloses a golf bag having inflatable air bladders mounted on a cross-member and disposed near the top opening of the bag. The bladders are inflatable using a squeezable bulb-shaped pump. When inflated, the bladders exert pressure about the golf club shafts to prevent the clubs from moving within the bag. Absent from this invention, however, is any means for protecting the heads of the clubs against damage caused by external sources.

There is accordingly a need for a cover for a golf bag that protects the golf equipment carried therein, especially the golf club heads, from contacting each other and from being damaged by contact with external elements.

SUMMARY OF THE INVENTION

The present invention is directed to a removable protective cover used in combination with a golf bag. The cover includes a bladder for protecting the heads of golf clubs and other equipment carried in a golf bag. The cover is removeably attachable to a golf bag and affixable thereto by a zipper or other similar securing means. Once fastened to the golf bag, the bladder, which is initially in a deflated or non-inflated condition, may be inflated to surround the golf club heads and provide a protective barrier against the club heads contacting each other and against club heads contacting some other hard surface, e.g. the ground, conveyor belt, etc. The bladders may also be partially inflated to provided a reduced degree of security and protection to the golf club heads. The golf bag and cover are preferably constructed of hard external shells. When used in combination, the cover and golf bag of the present invention provide a single container, i.e. golf bag, equally suitable for use on the golf course and for travel.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
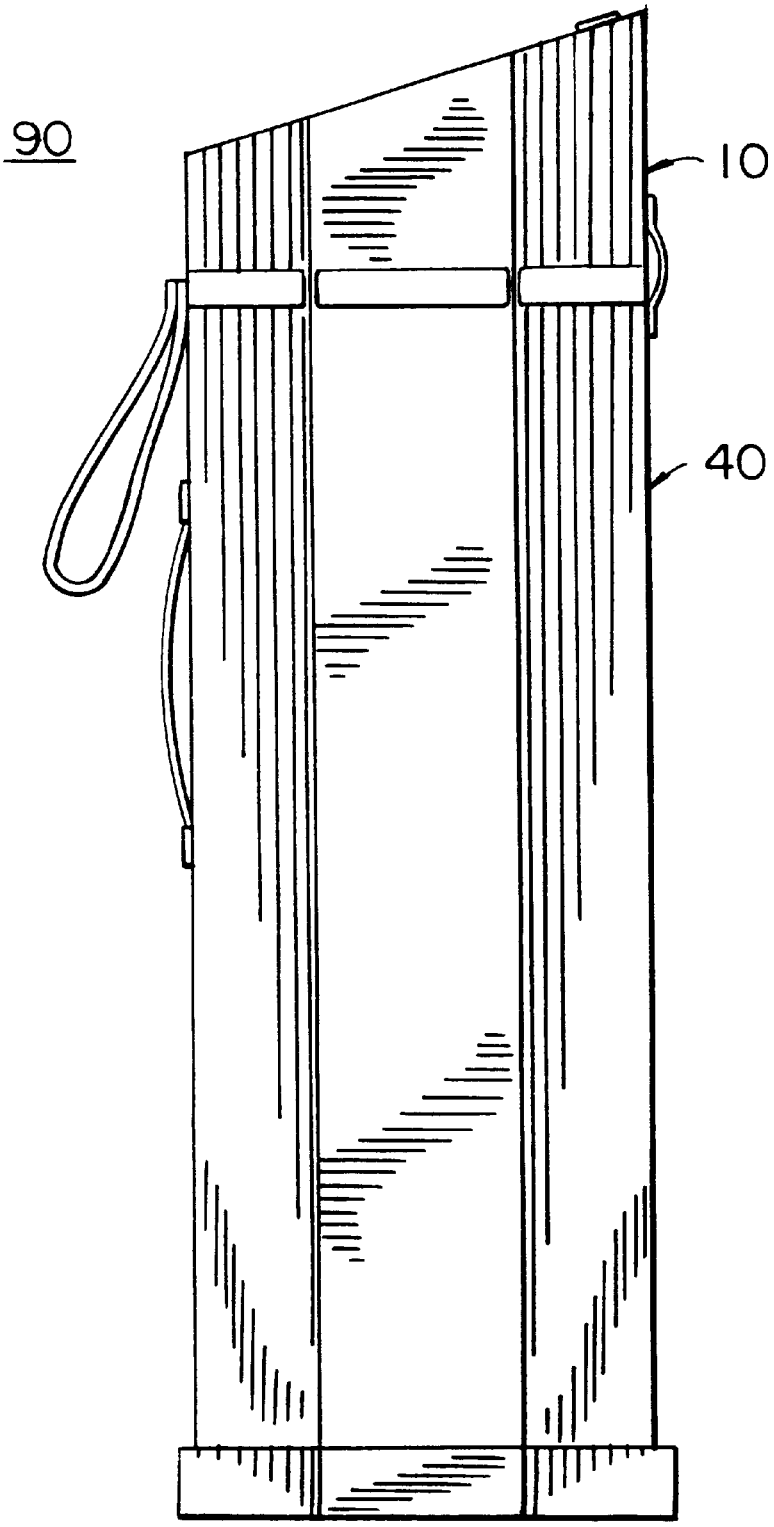
FIG. 1 is a side view of a golf bag and cover configured in accordance with the present invention.
Figure 2:
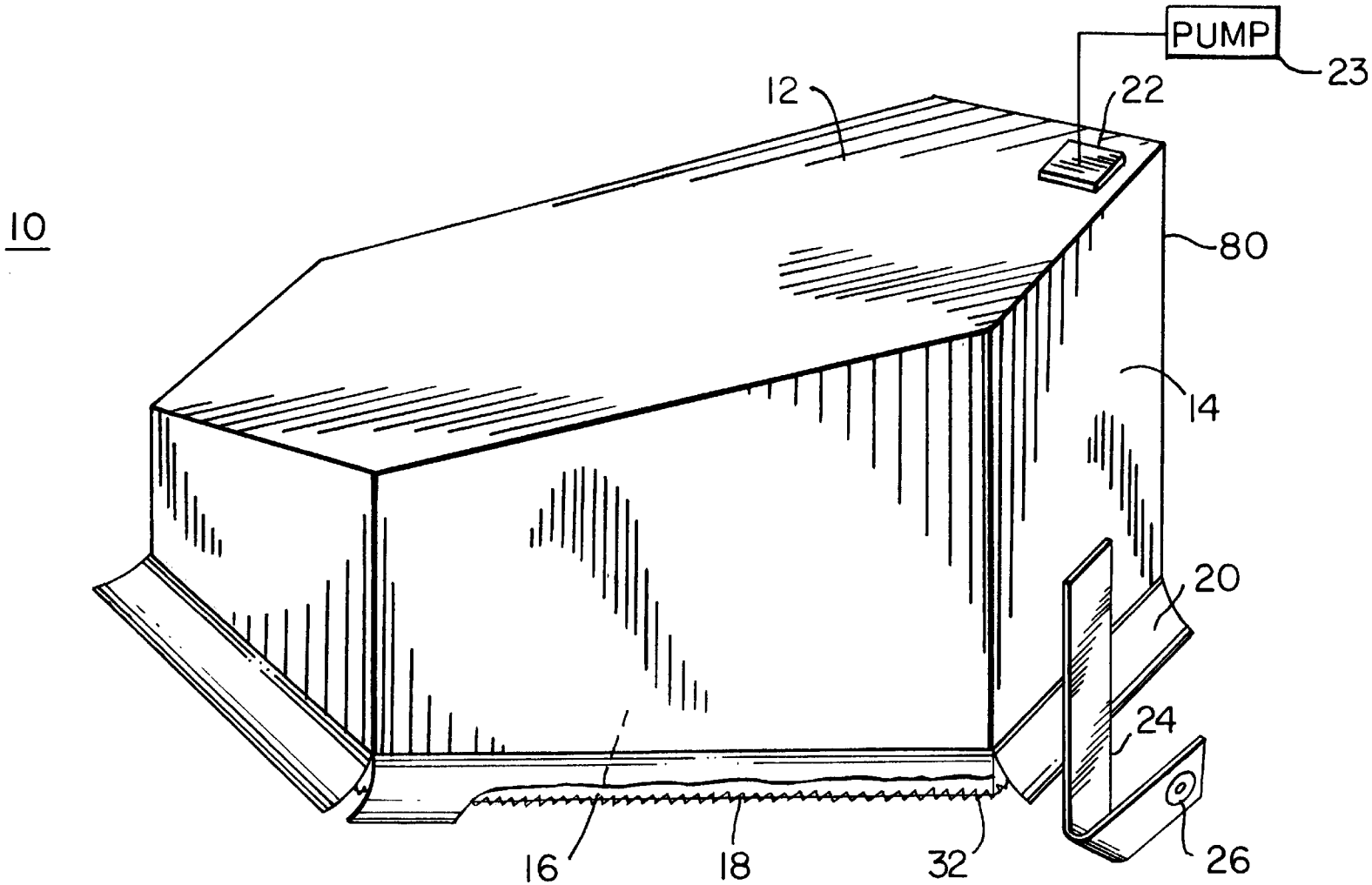
FIG. 2 is an elevated perspective view of the cover of the present invention shown in FIG. 1.
Figure 3:
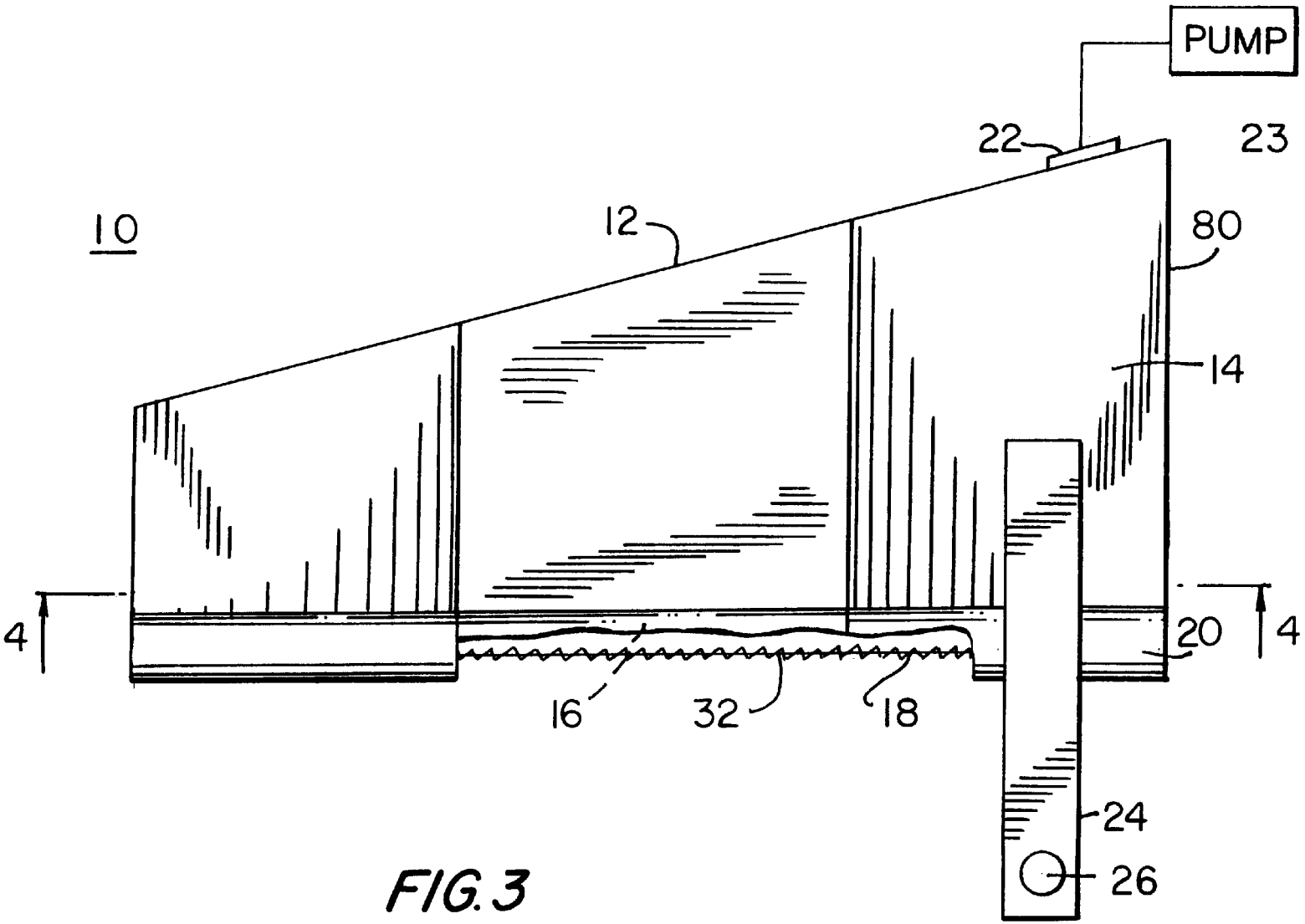
FIG. 3 is a side view of the cover of the present invention shown in FIG. 2.

Referring now to the drawings, FIG. 1 depicts a golf bag 40 and removable protective cover 10 constructed in accordance with the present invention and collectively designated at 90. As shown more clearly in FIGS. 2, 3, and 4, the cover 10 comprises a cap 80 having an inclined top surface 12 having a periphery and a wall 14 extending in a generally vertical downward direction therefrom. The wall 14 terminates at a rim 32 and defines an inner compartment 16 in the cover 10. In a preferred embodiment, the cover 10 is hexagonal in cross-section and is constructed of hard plastic or structural foam or any other light-weight impact resistant material. Alternatively, the cover 10 may have other equally acceptable geometric cross-sectional profiles such as, for example circular. A zipper first half 18 or other resealable closing means is affixed to the cover 10 and is disposed about the rim 32 for securing the cover 10 to a golf bag 40 (FIG. 5) having a complementary closing means. A plurality of flexible flaps 20 are connected to the cover 10 and are disposed about the wall 14 near the rim 32. The flaps 20 extend downward past the rim 32 and cover the zipper first half 18 when the cover 10 and golf bag 40 are configured as shown in FIG. 1.

The cover 10 includes an insulating and securing means for protecting the heads of golf clubs and other equipment carried in the golf bag 40. In a preferred embodiment, a plurality of inflatable bladders 30 are secured within and disposed peripherally about the inner compartment 16 of the cover 10 and are more clearly illustrated in FIG. 4. Additionally, some of the bladders 30 may also be secured to and extend generally downward from an inner top surface of the cover 10 and may be arranged in various configurations suitable for securing and protecting the golf club heads. One such configuration is shown, by way of non-limiting example, in FIG. 4. It will be obvious to one skilled in the art that many configurations are possible which will accomplish the protective effect of the cover 10 of the present invention. For example, a cover 10 may include a pre-configured structure, i.e. a foam rubber or styrofoam lattice-like configuration, on an inner surface sized and shaped to accept the golf club heads and secure them against movement. In addition, various alternatives to the preferred plurality of bladders can also effect the desired separation and protection of the golf clubs and equipment such as, for example, a single bladder comprising a single compartment, a single bladder comprising a plurality of separate compartments, a foam-like material, styrofoam, or any other malleable or deformable material. While the bladders 30 are initially deflated or non-inflated, they are selectively extendable from the deflated condition to an inflated condition. Of course, the bladders 30 may be selectively partially inflated.

When inflated, the bladders 30 surround the heads of the golf clubs carried in the golf bag 40 thereby securing the golf clubs in place and preventing accidental contact between and among the heads. Other equipment carried in the golf bag 40 and enclosed by the cover 10 is likewise protectively surrounded. Alternatively, a single bladder may envelop the golf clubs and equipment and exert pressure thereon so as to hold the clubs and equipment in place and prevent movement thereof during transit.

The bladders 30 are inflatable and deflatable via a valve 22 protruding through the top surface 12 of the cover 10 using, for example, a hand-pump 23 which may be removably connected to the valve 22. It will be obvious to one skilled in the art that various types of pumps, hand-held and otherwise, or similar fluid delivery means may be used to inflate the bladders 30. The valve 22 may alternatively protrude through the wall 14 or other user accessible area of the cover 10. The bladders 30 are connected to each other and to the valve 22 by a network of capillaries or other similar fluid communicating means (not shown) contained within the cover 10. The bladders 30 may be collectively inflated to a user selectable size, depending on the degree of security and club protection desired. For example, the bladders 30 may be minimally inflated while carrying the golf bag 40 and cover 10 to and from the clubhouse, for example. Alternatively, the bladders 30 may be maximally inflated when transporting the golf bag 40 and cover 10 on an airplane or in the trunk of a car. A varying degree of protection for the golf clubs is thereby possible depending on the extent to which the bladders 30 are inflated.

A plurality of flexible tabs 24 each having a snap 26 or other detachable fastening means secured thereto are affixed to the cover 10. The flexible tabs 24 allow the cover 10 to be removably attached to the golf bag 40 and pivoted between an open position and a closed position. When in the closed position, the cover 10 envelopes the golf club heads such that inflation of the bladders 30 will exert lateral pressure onto the heads thereby securing and protecting the golf club heads and golf equipment carried in the golf bag 40 and thereby preventing contact among the golf club heads and equipment during handling and transit.

When in the closed position, the rim 32 of the cover 10 rests in abutting relation with a complementary upper rim 46 (FIG. 5) of the golf bag 40. In this position, the zipper first half 18 or closing means may be used in combination with a zipper second half 48 or other complementary closing means attached to the golf bag 40 to sealingly secure the cover 10 to the golf bag 40, thereby creating a substantially unitary container for carrying and otherwise transporting golf equipment. The plurality of flaps 20 are selectively moveable to cover the joined zipper halves 18, 48 to present a clean appearance when the cover 10 is in the closed position.

Since the cover 10 is made from impact resistant material, it also protects the golf club heads from damage caused by contact with other objects, e.g. the ground, conveyor belts, walls, etc.

Figure 4:
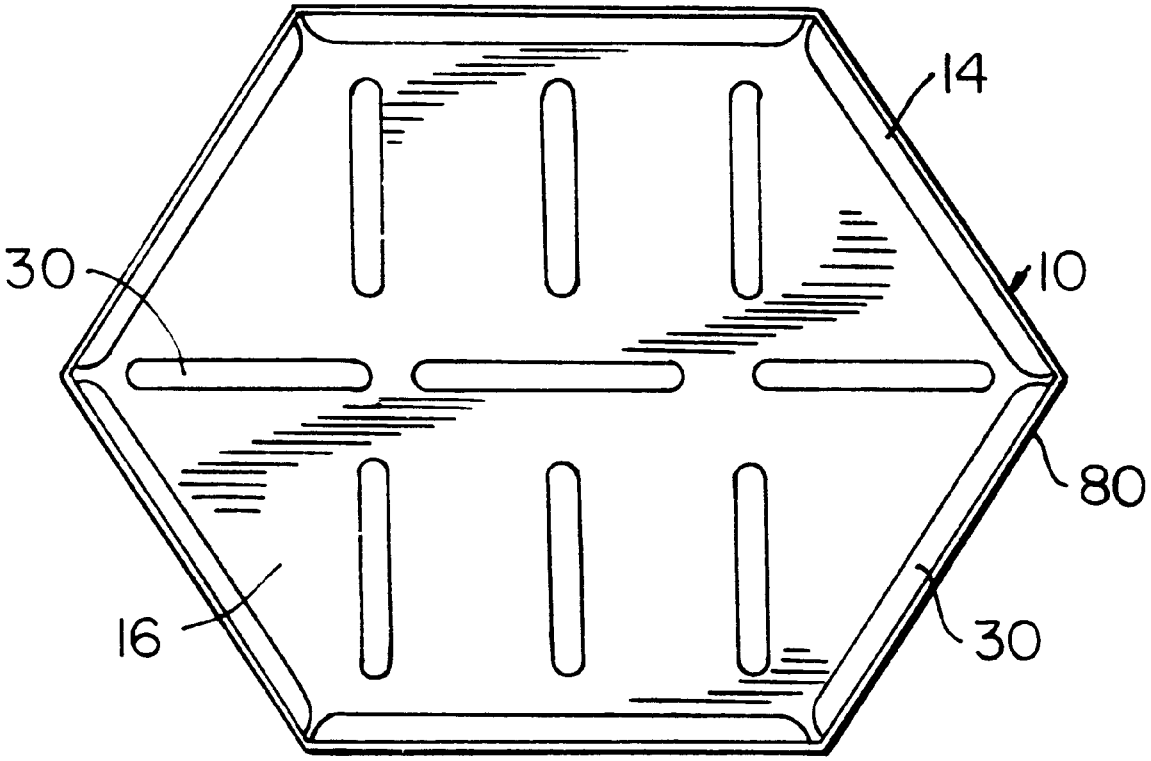
FIG. 4 is a bottom plan view of the cover of the present invention shown in FIG. 2 showing the bladder in a deflated condition.

Preferably, the golf bag 40 has the same cross-sectional profile as the cover 10, i.e. a substantially hexagonal, as shown in FIG. 4. Alternatively, the golf bag 40 may have other geometric cross-sectional profiles such as, for example, circular, but in any case, matching that of the cover 10. The golf bag 40 is constructed of a lightweight yet strong material such as, for example, Kevlar® or nylon. In addition, the outer surface of the golf bag 40 is padded and water-resistant.

The golf bag 40 includes a bottom cap 42 having a substantially horizontal bottom and an upwardly extending cap wall 44 coaxial with the golf bag 40. The cap wall 44 of the bottom cap 42 encircles the bottom of the golf bag 40 in circumferential overlapping fashion. In a preferred embodiment, the cap wall 44 extends upward approximately five inches and is secured to the golf bag 40 by nylon stitching or other similar semi-permanent securing means. The bottom cap 42 is preferably made of a shock absorbing material, preferably a heavy rubber, and is configured to allow the golf bag 40 to stand freely, i.e. without additional supporting means. Alternatively, the bottom cap 42 is made of a hard shell plastic such as, for example, polyvinylchloride (PVC).

A vertically oriented handle 50 is fixedly attached to a side of the golf bag 40 thereby providing a carrying means for the golf bag 40. An expandable pocket 52 and umbrella holder (not shown) are provided on a side of the golf bag 40 for carrying miscellaneous golf attire and equipment, e.g. shoes, windbreaker, umbrella, etc.

The golf bag 40 has an open end which defines a peripheral upper rim 46 to which a zipper second half 48 or other selectively closable device is affixed. The zipper second half 48 is configured for interlocking engagement with the zipper first half 18 provided on the cover 10 when the cover 10 is in the closed position, as illustrated more clearly in FIGS. 1 and 8.

Figure 6:
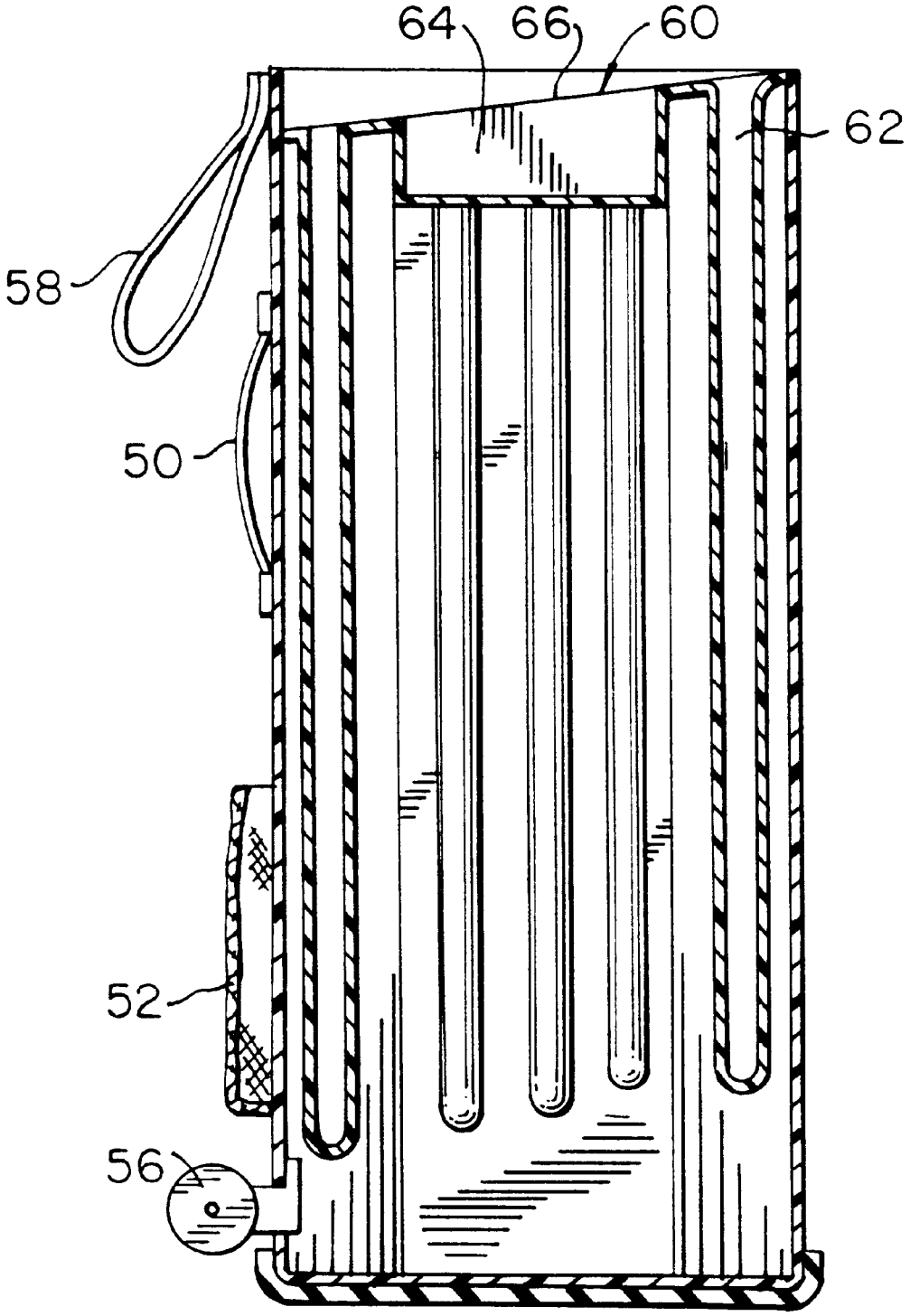
FIG. 6 is a cross-sectional view of the golf bag of the present invention taken along the line 6—6 of FIG. 5.

Clips 54 or other similar retention devices are defined in the golf bag 40 near the bottom cap 42 for removably mounting casters or wheels 56 to the golf bag 40 and are shown more clearly in FIG. 6. The casters or wheels 56 facilitate transporting the golf bag 40 through an airport or on a golf course, for example. A flexible pull strap 58 is fastened near the open end of the golf bag 40 for use with the casters or wheels 56. A removable shoulder strap (not shown) is also provided for carrying the golf bag 40.

Figure 5:
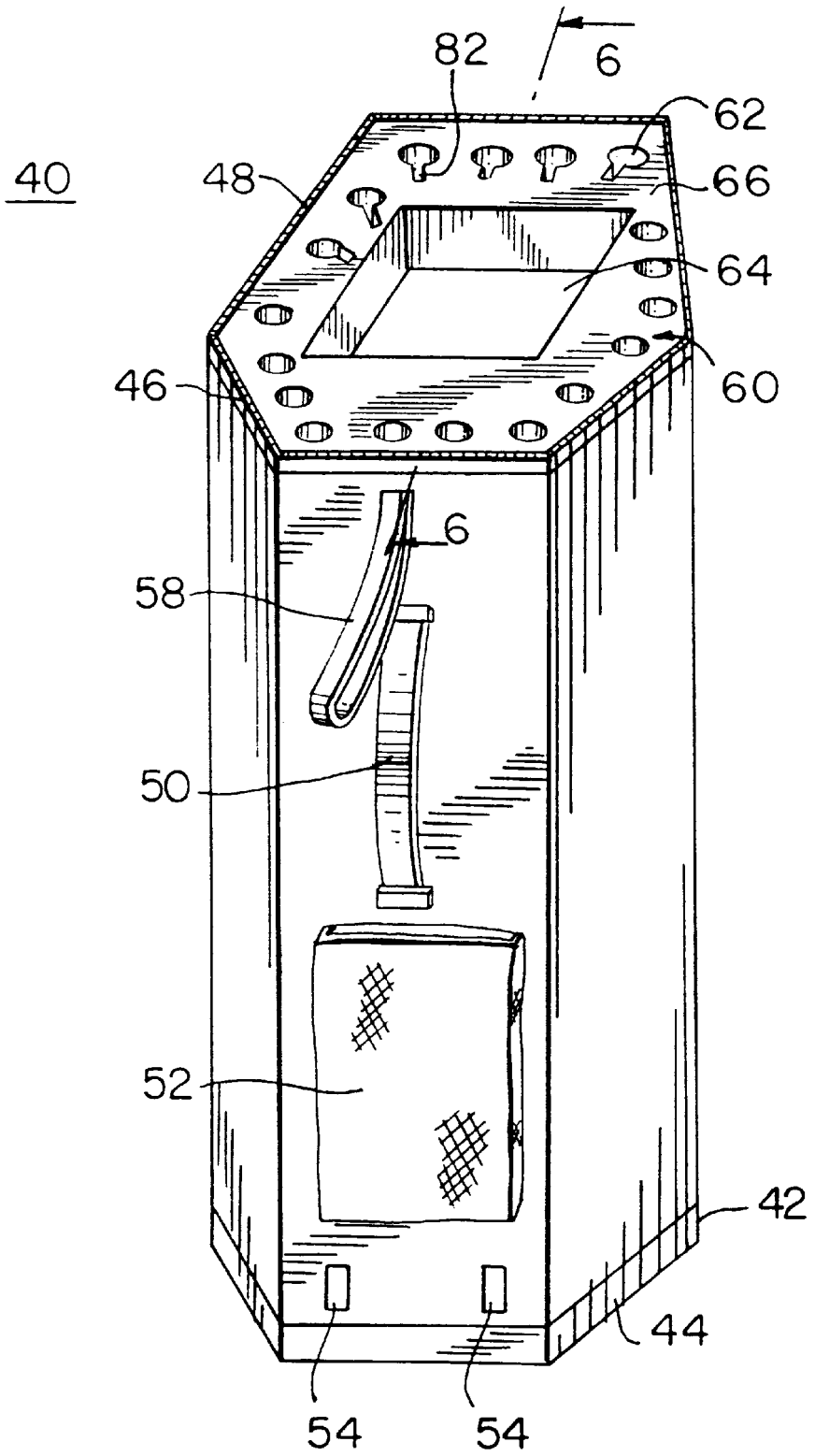
FIG. 5 is an elevated perspective view of the golf bag of the present invention shown in FIG. 1.

Referring next to FIGS. 5 and 6, a tray 60 is depicted which is mounted within and near the open end of the golf bag 40. The tray 60 is configured to hold golf clubs, golf balls, golf tees, golf shoes, etc., and has a plurality of substantially vertical downwardly extending tubes 62 defined therein. The tubes 62 extend longitudinally from the top portion of the golf bag 40 generally downward toward the bottom cap 42. The tubes 62 are open at both ends or alternatively, may be open at the top and partially closed at the bottom. In either case, the tubes 62 are not completely sealed at the bottom so that water, dirt, and the like will not be trapped therein and cause damage to the golf club shafts and handles. In a preferred embodiment, fourteen tubes 62 are provided.

In an alternative embodiment, a key 82 is defined in the top surface of the tray 60. The key 82 is sized and shaped to accept a variety of golf clubs and to secure same against rotation while held by the tray 60. This feature allows the use of a cover 10 having a predefined isolation and securing structure to be used in combination with the golf bag 40, i.e. the isolation and securing structure need not be manipulated to hold the golf clubs and equipment in place.

The tray 60 is preferably made of hard plastic or structural foam or a combination thereof. Alternatively, any durable yet lightweight material may be used to manufacture the tray 60. The tray 60 has an inclined top surface 66 which matches the incline of the top surface 12 of the cover 10 and which compensates for varying golf club lengths so that the heads of all the golf clubs will lay on approximately the same horizontal plane when carried by the tray 60. The inclined top surface 66 also facilitates access to the golf clubs and other golf paraphernalia carried in the tray 60.

The tray 60 has a recess 64 defined therein which is generally polygonal and is suitable for holding golf shoes, balls, tees, etc. A utility outlet (not shown) is included in the tray 60 in the form of a cigarette lighter for connection to a cellular phone or a computer, for example. A cigar or cigarette holder (not shown) is also provided in the tray 60.

Figure 7:
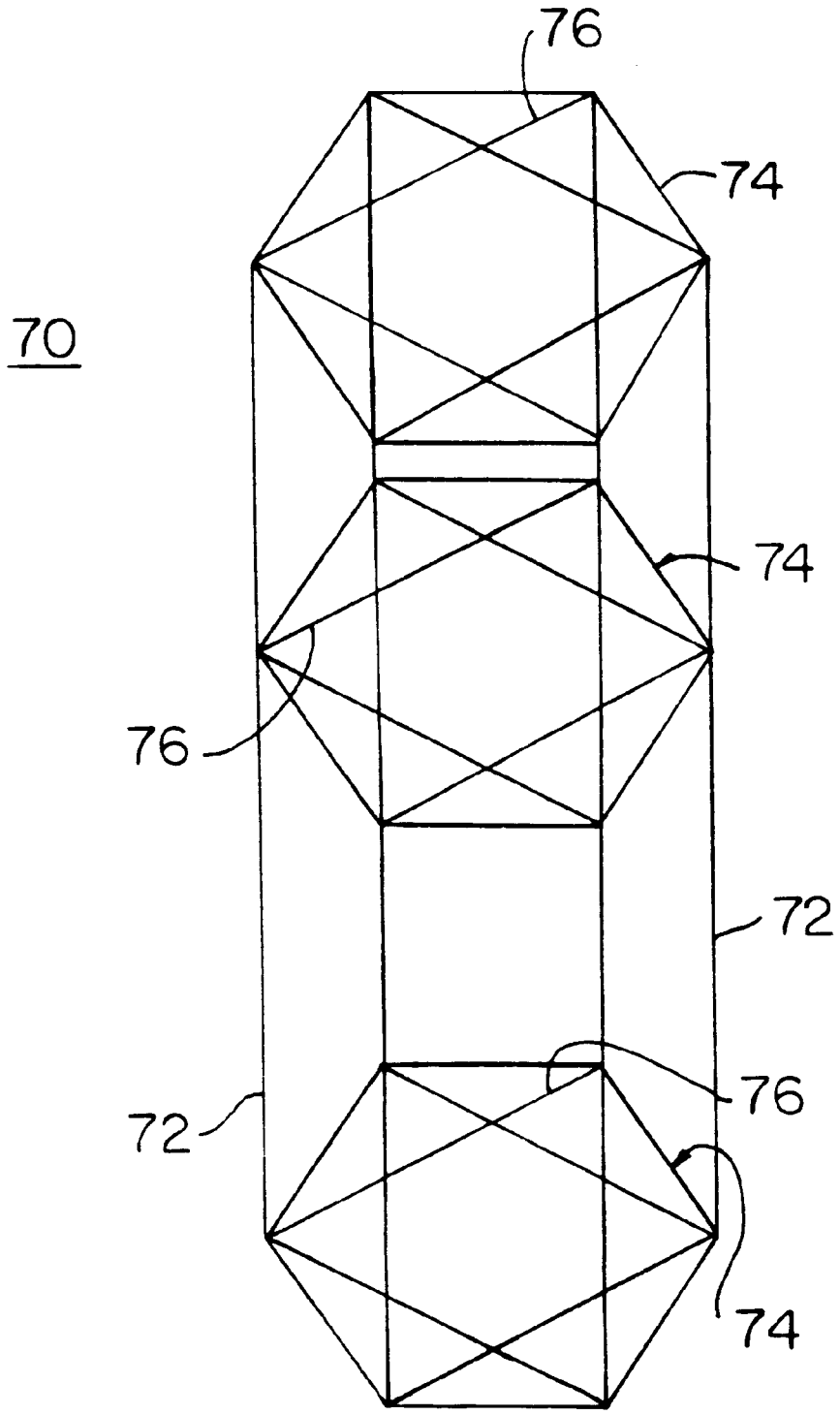
FIG. 7 is an elevated perspective view of the support structure of the golf bag configured in accordance with the present invention.

A support structure 70 is depicted in FIG. 7 which is disposed within the golf bag 40 and which lends lateral and radial support thereto. For a golf bag 40 having a substantially hexagonal cross-section, the support structure 70 comprises a system of vertical support rods 72 and horizontally disposed hexagonal cross-members 74 fastened thereto. A plurality of horizontal support rods 76 are traversely mounted to each cross-member 74 for additional structural support. Although the preferred embodiment of the golf bag 40 and cover 10 are hexagonal in cross-section, it will be obvious to one skilled in the art that the configuration of the support structure 70 must comport with that of the cover 10 and golf bag 40.

The support rods 72 originate at the bottom cap 42 and terminate at the upper rim 46 of the golf bag 40. Three cross-members 74 are vertically equidistantly disposed within the golf bag 40, preferably, adjacent the bottom cap 42, approximately mid-way between the bottom cap 42 and the upper rim 46, and just below the upper rim 46. The support rods 72 are preferably made of steel, although other materials having the same strength-to-weight characteristics may also be used. The cross members 74 and horizontal support rods 76 are preferably made of rugged plastic, e.g. PVC, although lightweight steel, aluminum, or other lightweight yet strong materials may be used.

Figure 8:
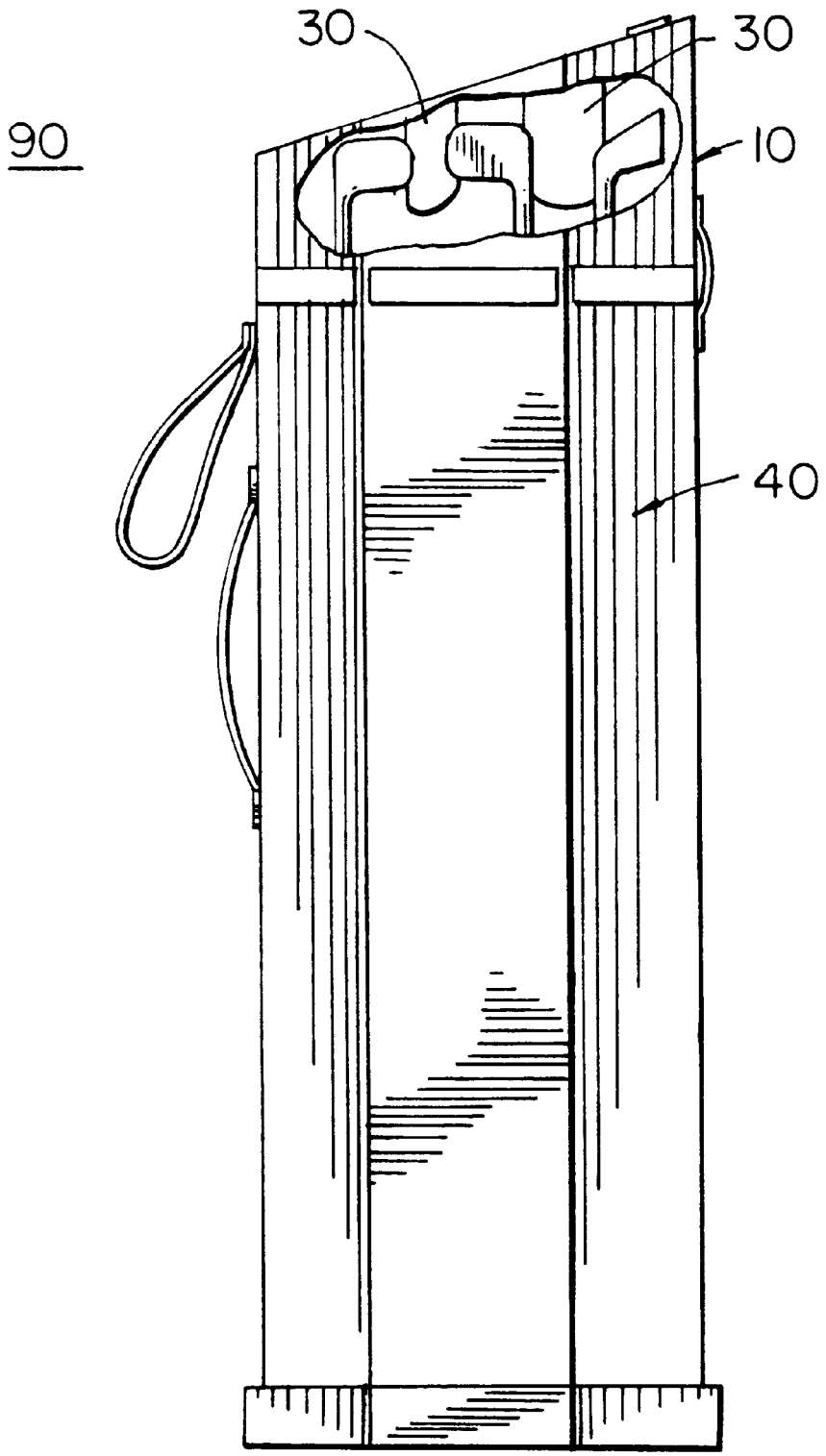
FIG. 8 is a side view of the golf bag and cover of the present invention showing the cover in the closed position and a partially cut-away, showing the bladder in an inflated condition.

In operation, and referring to FIG. 8, the cover 10 is releasably secured to the golf bag 40 using the snaps 26 and pivoted to the closed position so that the cover 10 enclosingly envelops the golf club heads and the zipper halves 18, 48 lie confrontingly opposite each other. The zipper halves 18, 48 are fastened together to secure the cover 10 in place and the flaps 20 are moved to conceal the zipper halves 18, 48 from view. The bladders 30 may be collectively inflated by attaching a removable hand-pump 23 to the valve 22. Once the bladders 30 are inflated, the golf clubs are safely secured in the golf bag 40 and protected by the bladders 30 and the cover 10 from damage. Additional protection is provided by the hard-shell construction of the cover 10 and golf bag 40. The golf bag 40 and cover 10 may now be carried using the handle 50 or shoulder strap. If desired, the removable wheels or casters 56 may be affixed to the golf bag 40, allowing the user to roll the golf bag 40 using the pull-strap 58. When configured thusly, the golf bag 40 and cover 10 are easily transported through airports, across parking lots, though hotel lobbies, etc.

Although the cover 10 has been described and illustrated as having a plurality of inflatable bladders 30, a single inflatable bladder comprising a single cavity may be used to produce the desired isolation and securing effect of the present invention. Alternatively, a single inflatable bladder comprising a plurality of cavities, a pre-configured foam rubber or styrofoam structure, for example, whether used alone or in combination, will perform the desired effect of the present invention.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A rigid, impact resistant cover for closing an open end of a golf bag defining a bag interior cavity and configured for carrying in the bag cavity a plurality of golf clubs each having an elongated shaft for disposition in the bag cavity and a club head on an end of the shaft for projection from the bag cavity through the bag open end when the shaft is disposed in the bag cavity, said cover comprising:

a peripheral wall defining a chamber within which the golf club heads projecting from the bag cavity are disposed when said cover is disposed on the golf bag so as to close the bag open end; and a plurality of inflatable bladders carried on said cover wall within said chamber and selectively extendable between an inflated condition in which said bladders extend into closely proximate relation with the projecting golf club heads projecting from the bag and into said cover chamber when said cover is disposed on the golf bag so as to close the bag open end, and a deflated condition in which said bladders are disposed out of said closely proximate relation with the projecting golf club heads, said bladders being configured so that in said inflated condition the bladders protectingly envelope and secure the golf club heads against potentially damaging contact with one another and in said deflated condition said bladders are disposed so as to separate at least some of the projecting golf club heads from at least others of the projecting golf club heads.

2. The cover of claim 1, wherein said bladders abbutingly contact the golf club heads when said bladders extend into closely proximate relation with the projecting golf club heads.

3. The cover of claim 1, further comprising means for inflating said bladders so as to extend said bladders from the deflated condition to the inflated condition.

4. The cover of claim 3, wherein said inflating means further comprises:

a valve carried on said peripheral wall of said cover and connected to said bladders for communication therewith; and a pump removably connectable to said valve and configured for delivering a fluid to said bladders to selectively extend said bladders from said uninflated condition to said inflated condition;

said valve being configured to sealingly contain said fluid in said bladders when said bladders are in said inflated condition and to selectively release said fluid from said bladders to contract said bladders from said inflated condition to said uninflated condition.

5. The cover of claim 1, wherein said cover is substantially hexagonal in cross-section.

6. The cover of claim 5, wherein said cover further comprises an inclined top surface having a periphery, said cover peripheral wall extending generally downward from said top surface periphery so as to close the golf bag open end when said cover is disposed on the golf bag.

7. The cover of claim 1, wherein said cover further comprises an inclined top surface having a periphery, said cover peripheral wall extending generally downward from said top surface periphery so as to close the golf bag open end when said cover is disposed on the golf bag, said plurality of inflatable bladder being attached to said inclined top surface so as to extend generally downward therefrom.

8. The cover of claim 1, wherein said cover further comprises an inclined top surface having a periphery, said cover peripheral wall extending generally downward from said top surface periphery so as to close the golf bag open end when said cover is disposed on the golf bag, at least one of said inflatable bladders being attached to said inclined top surface so as to extend generally downward therefrom and at least one of said inflatable bladders being attached to said peripheral wall.

9. In combination:

a golf bag having an open end and defining a bag interior cavity and configured for carrying in said bag cavity a plurality of golf clubs each having an elongated shaft for disposition in said bag cavity and a club head on an end of the shaft for projection from said bag cavity through said bag open end when the shaft is disposed in said bag cavity; and a rigid, impact resistant cover for closing the open end of said golf bag, said cover comprising:

a peripheral wall defining a chamber within which the golf club heads projecting from the bag cavity are disposed when said cover is disposed on the golf bag so as to close the bag open end; and a plurality of inflatable bladders carried on said cover wall within said chamber and selectively extendable between an inflated condition in which said bladders extend into closely proximate relation with the projecting golf club heads projecting from the bag and into said cover chamber when said cover is disposed on the golf bag so as to close the bag open end, and a deflated condition in which said bladders are disposed out of said closely proximate relation with the projecting golf club heads, said bladders being configured so that in said inflated condition the bladders protectingly envelope and secure the golf club heads against potentially damaging contact with one another and in said deflated condition said bladders are disposed so as to separate at least some of the projecting golf club heads from at least others of the projecting golf club heads.

10. The combination of claim 9, wherein said bladders abbutingly contact the golf club heads when said bladders extend into closely proximate relation with the projecting golf club heads.

11. The combination of claim 9, further comprising means for inflating said bladders so as to extend said bladders from the deflated condition to the inflated condition.

12. The combination of claim 11, wherein said inflating means further comprises:

a valve carried on said peripheral wall of said cover and connected to said bladders for communication therewith; and a pump removably connectable to said valve and configured for delivering a fluid to said bladders to selectively extend said bladders from said uninflated condition to said inflated condition;

said valve being configured to sealingly contain said fluid in said bladders when said bladders are in said inflated condition and to selectively release said fluid from said bladders to contract said bladders from said inflated condition to said uninflated condition.

13. The combination of claim 9, wherein said golf bag includes a peripheral sidewall and said bag peripheral sidewall and said cover peripheral wall being sized and configured so that said cover chamber forms an extension of said bag interior cavity to define a single golf club holding chamber when said cover is disposed on said bag so as to enclose said bag open end.

14. The combination of claim 9, wherein said cover and said golf bag are substantially hexagonal in cross-section.

15. The combination of claim 14, wherein said cover further comprises an inclined top surface having a periphery, said cover peripheral wall extending generally downward from said top surface periphery so as to close the golf bag open end when said cover is disposed on the golf bag.

16. The combination of claim 15, wherein said golf bag includes a substantially horizontal bottom surface that is non-parallel with said inclined top surface of said cover.

17. The combination of claim 9, wherein said golf bag further comprises a support structure disposed within said interior cavity of said golf bag and configured for providing lateral support to said golf bag.

18. The cover of claim 9, wherein said cover further comprises an inclined top surface having a periphery, said cover peripheral wall extending generally downward from said top surface periphery so as to close the golf bag open end when said cover is disposed on the golf bag, said plurality of inflatable bladders being attached to said inclined top surface so as to extend generally downward therefrom.

19. The cover of claim 9, wherein said cover further comprises an inclined top surface having a periphery, said cover peripheral wall extending generally downward from said top surface periphery so as to close the golf bag open end when said cover is disposed on the golf bag, at least one of said inflatable bladders being attached to said inclined top surface so as to extend generally downward therefrom and at least one of said inflatable bladders being attached to said peripheral wall.

* * * * *